United States Patent [19]

Wilson

[11] 4,075,863

[45] Feb. 28, 1978

[54] FREEZE-HARVEST CONTROL SYSTEM FOR A TUBULAR ICE MAKER

[75] Inventor: William H. Wilson, Carthage, Mo.

[73] Assignee: Storm King Products, Inc., Carterville, Mo.

[21] Appl. No.: 716,596

[22] Filed: Aug. 23, 1976

[51] Int. Cl.[2] ..... F25C 1/06

[52] U.S. Cl. ..... 62/138; 62/352

[58] Field of Search ..... 62/135, 139, 352, 138, 62/156

[56] References Cited

U.S. PATENT DOCUMENTS

| | | | |
|---|---|---|---|
| 2,921,447 | 1/1960 | Gotischalk | 62/139 |
| 3,029,611 | 4/1962 | Kuhn | 62/156 |
| 3,068,660 | 12/1962 | Council et al. | 62/352 X |
| 3,392,540 | 7/1968 | Council et al. | 62/352 X |
| 3,877,242 | 4/1975 | Creager | 62/352 X |

*Primary Examiner*—William E. Wayner
*Assistant Examiner*—William E. Tapolcai, Jr.
*Attorney, Agent, or Firm*—Head, Johnson & Chafin

[57] ABSTRACT

An improved freeze-harvest cycle control system for use in tubular type refrigerated ice makers having a water level control pan wherein a drop in the control pan water level is detected and used to initiate the harvest cycle. Temperature controls on the water tube discharge are used in conjunction with the water level control means to insure completion of the harvest cycle before commencement of the freeze cycle.

5 Claims, 1 Drawing Figure

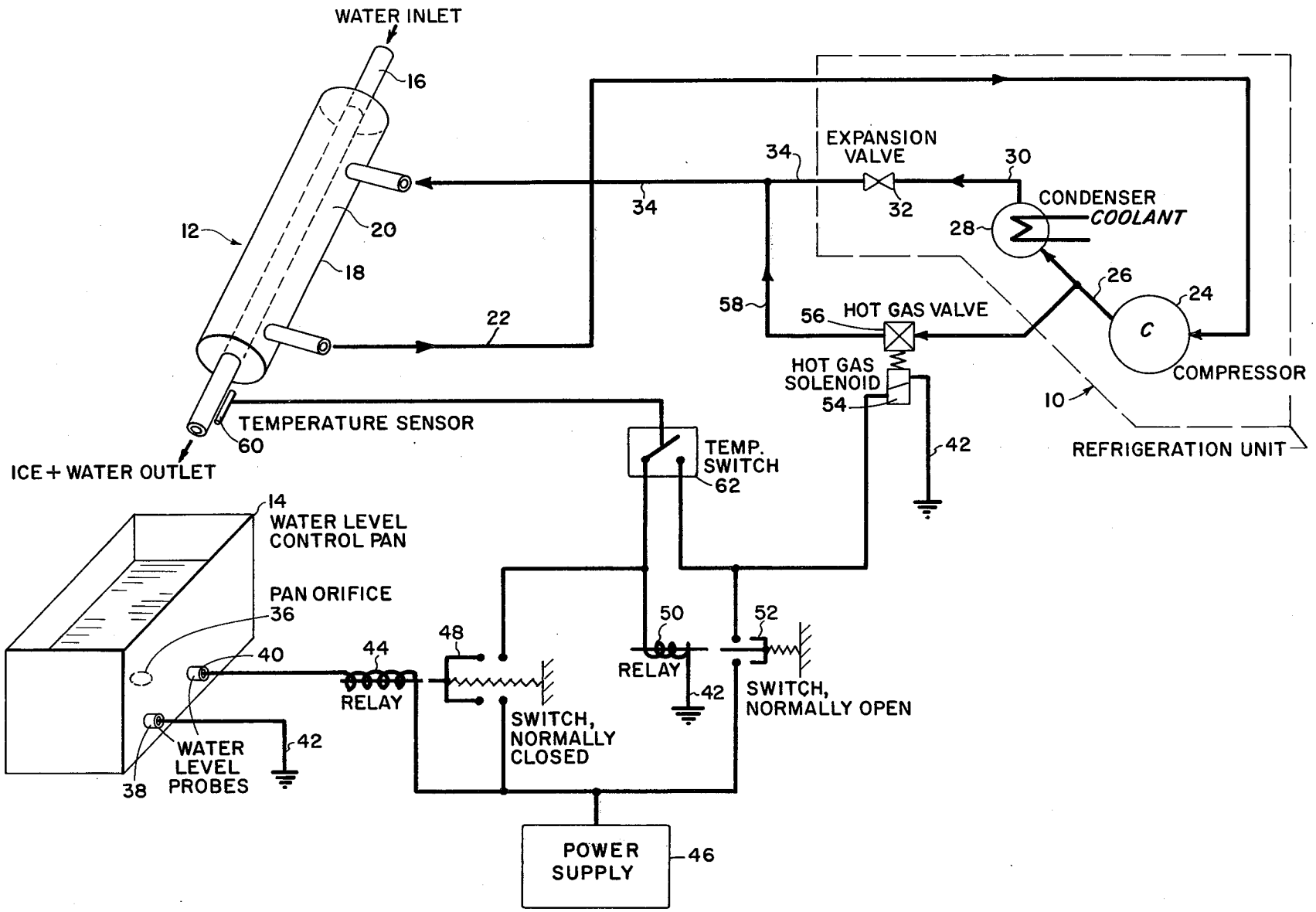
REFRIGERATION UNIT
10
COMPRESSOR
24
C
26
CONDENSER
COOLANT
28
30
EXPANSION VALVE
32
34
HOT GAS VALVE
56
58
HOT GAS SOLENOID
54
42
TEMP. SWITCH
62
SWITCH, NORMALLY OPEN
52
RELAY
50
SWITCH, NORMALLY CLOSED
48
RELAY
44
POWER SUPPLY
46
WATER INLET
16
20
18
22
12
TEMPERATURE SENSOR
60
ICE + WATER OUTLET
14
WATER LEVEL CONTROL PAN
PAN ORIFICE
36
40
WATER LEVEL PROBES
38

FREEZE-HARVEST CONTROL SYSTEM FOR A TUBULAR ICE MAKER

BACKGROUND OF THE INVENTION

Tubular ice makers normally freeze water flowing through a length of tubing by circulating cold refrigerant through an annular space outside the tubing. As water freezes inside the tubing, an annular shaped ice mass is formed, having an outside diameter equal to the inside diameter of the tubing and having an inner diameter dependent upon the length of the freezing cycle. As the ice mass forms, the water flow through the tubing decreases in proportion to the shrinking inner diameter of the annular frozen mass, squared. Water exiting from the tubing during the freezing cycle is normally collected in a control pan or container having a small orifice in the bottom thereof for drainage. When the water flow through the tubing decreases to the point that drainage through the control pan orifice exceeds the flow into the pan, the water level inside the control pan will drop. Detection of the fall in water level thus provides a convenient means of ascertaining the end point of the freezing cycle since the control pan orifice size may be altered to produce an annular ice mass having the desired inner diameter.

After the properly sized ice is formed, hot discharge refrigerant gas from the refrigerant compressor is routed by means of a solenoid operated valve directly to the annular space outside the tubing instead of first passing the gas through the condensor and expansion valve as in the freezing cycle. The flow of hot gas replacing the cold refrigerant serves to melt the outside surface of the ice adhering to the tubing and the water pressure at the tubing inlet flushes the ice product from the tubing outlet. After the ice is thus harvested the freezing cycle may again commence.

As is readily observed, the efficiency of the system is highly dependent upon minimizing the length of the harvest cycle in comparison to the length of the freezing cycle. Care must be taken, however, to insure that all ice is removed during the harvest cycle to prevent damage to the equipment during the freezing cycle. Many problems have been encountered heretofore as a result of incomplete harvesting permitting ice blockage during the freezing cycle with subsequent rupture of the water tubing.

SUMMARY OF THE INVENTION

The present invention contemplates an improved freeze-harvest cycle control system for use in a tubular ice maker of the refrigeration type having a water level control pan and a solenoid operated hot gas valve for initiating the ice harvest cycle. The novel system is particularly designed to surmount existing obstacles in regard to equipment safety while maximizing unit efficiency.

The invention basically comprises a means for detecting a drop in water level in the control pan, signifying completion of the freeze cycle, means for initiating the harvest cycle triggered by said drop in water level and latching means for continuing the harvest cycle until the control pan water level rises and the temperature of the water tube outlet rises indicating that complete flushing of the ice has occurred. The dual water level and temperature control mechanism assures equipment protection commensurate with high unit efficiency.

BRIEF DESCRIPTION OF THE DRAWING

The drawing shows a schematic view of the invention as the same relates to the refrigeration unit, water level control pan and tubular freezing apparatus of a tubular ice maker.

DESCRIPTION OF THE PREFERRED EMBODIMENT

Before describing the preferred embodiments of the present invention in detail for the better understanding and instruction of those who may wish to apply the invention to their own particular needs, it is to be understood that the invention is not limited in application to the details of construction and arrangement of components as is illustrated in the accompanying drawings, as other and further modifications apart from those described or suggested herein, may be made in the spirit and scope of this invention. Also, it should be understood that the particular phraseology or terminology employed herein is for the purpose of illustration and instruction and not for the purpose of limitation.

The attached drawing generally shows the invention as it functions with respect to a refrigeration unit 10, a tubular freezing apparatus 12, and a water level control pan 14 of a tubular ice maker. Reference character 12 generally indicates the tubular freezing apparatus comprising a water tube 16 concentrically arranged inside a refrigerant tube 18. In most units the tubing is coiled, but is shown herein as a straight length for purposes of illustration. The refrigerant tube 18 is sealed at each end thereof to the water tube 16 to provide an annular space 20 for the circulation of a fluid from the refrigeration unit, which unit is generally indicated by reference character 10. During the freezing cycle, water is admitted under pressure to the tube 16 and is discharged therefrom to a water level control pan 14. Cooling of the water is accomplished by circulation of cold refrigerant gas through the annular space 20. Line 22 is connected from refrigerant tube 18 in open communication with the annular space 20 to the suction port of compressor 24. Refrigerant gas, warmed by heat exchange with the water flowing through tube 16, flows through line 22 to compressor 24, where said gas is compressed and discharged through line 26 connected between compressor 24 and condenser 28. Condenser 28 is normally a water-cooled condenser, although other cooling mediums may be obviously employed. The hot compressed gas from the compressor discharge line 26 is cooled and condensed to a liquid phase in condenser 28. The cooled liquid refrigerant is passed via line 30 from the condenser to expansion valve 32. The pressure drop across valve 32 is such that the liquid is converted under near adiabatic conditions to a cold refrigerant gas. Expansion valve 32 is connected by line 34 to refrigerant tube 18 in open communication with the annular space 20 for supplying cold refrigerant gas to the tubular freezing apparatus, thus completing the cooling cycle performed by the refrigeration unit.

As water flows through line 16 during the freezing cycle, a portion of the water is frozen and forms an annular shaped ice mass adhering to the inner surface of tube 16. Water flow through the tube gradually decreases as the effective tube flow area becomes restricted by the forming ice mass. As previousy mentioned, water from tube 16 is discharged to the water level control pan 14. The water level control pan 14 has an orifice 36 in the bottom thereof for the drainage of water collected in said pan from tube 16. When the water flow rate from tube 16 decreases to the point that water is draining through the pan orifice 36 at a faster rate than is entering the pan from tube 16, the water level in the control pan will drop. Water level probes 38 and 40 are inserted in the pan 14 so as to have sole electrical contact with each other through water in the pan. Probe 38 is electrically connected to common ground 42, and probe 40 is connected to an electromagnetic relay 44 which in turn is electrically connected to the power supply 46. As is apparent, relay 44 is energized only when electrical contact is maintained between probe 38 and probe 40. A drop in the pan water level beneath either probe, signifying the end point of the freezing cycle, thus breaks electrical contact between the probes, short circuiting relay 44.

The short circuiting of relay 44 releases switch 48, which returns to its normally closed position. Switch 48 is electrically connected in series with relay 50 between a power supply 46 and common ground 42, and thus the closing thereof supplies power to energize relay 50. Energizing of relay 50 closes switch 52 which is normally open. Switch 52 is electrically connected in series with the hot gas solenoid 54 between the power supply 46 and common ground 42, thus closing of switch 52 energizes the hot gas solenoid causing the hot gas valve 56, normally closed, to open. The hot gas valve 56 is located in bypass line 58 connected between line 26 and line 34. Opening of the hot gas valve therefore causes the hot refrigerant gas in line 26 to bypass the condenser 28 and expansion valve 32 by flowing directly to line 34 and from line 34 to the annular space 20 of the tubular freezing apparatus. The circulation of hot gas in the tubular freezing apparatus melts the surface of the annular ice mass adhering to tube 16, and the ice therein is discharged by the force of the water pressure at the tube inlet. Ice flushed from tube 16 is channeled by metal fingers (not shown) to a storage compartment (not shown) and thereby kept from falling into the water level control pan 14. After all the ice is flushed from tube 16, the temperature of the water flowing therethrough will begin to rise as a result of heat exchange with the circulating hot gas. This rise in temperature is detected by temperature sensor 60 affixed to the end of tube 16. Temperature sensor 60 is operably connected to and controls temperature switch 62, which is normally closed, by opening said switch whenever the temperature rises above a temperature in the range of 35° to 40° F. Temperature switch 62 is electrically connected between the juncture of relay 50 and switch 48 and the juncture of switch 42 and the hot gas valve solenoid 54.

The opening of temperature switch 62 and switch 48 is required before power to the hot gas solenoid is cut as temperature switch 62, in the closed position for temperatures under the range 35°–40° provides to energize relay 50 once the harvesting cycle is started. Thus refilling of control pan 14 above the water probe level is insufficient to halt the cycle as long as ice remains in tube 16 to depress the water temperature flowing therethrough. The water temperature rise after the ice has been completely flushed is rapid, reaching the temperature range 35°–40° in less than 10 seconds. As a result the length of the harvest cycle is minimized and adequate safety is provided for the equipment.

What is claimed is:

1. An improved cycle control apparatus for a tubular type ice maker having a water level control pan, a hot gas valve solenoid for initiating the harvest cycle, and a water freezing tube, wherein the improvement comprises:

means for detecting a low water level in the water level control pan and energizing the hot gas valve solenoid to initiate the harvest cycle;

means for detecting the temperature of the discharge end of the water freezing tube; and means for holding the tubular ice maker in the harvest cycle until the control pan water level rises and the temperature at the discharge end of the freezing tube rises to predetermined points.

2. An improved cycle control apparatus for a tubular type ice maker having a water level control pan, a hot gas valve solenoid that when energized opens a normally closed hot gas valve to initiate the harvest cycle, a power source, and a water freezing tube, wherein the improvement comprises:

a first switch, normally open, but when closed operably connects the power source to the hot gas valve solenoid;

a first relay, when energized, closes the first switch;

a second switch, normally closed, that operably connects the power source to the first relay;

a second relay, that when energized, opens the second switch;

means for detecting a low water level in the water level control pan and for energizing the second relay when said level is above a predetermined level;

a temperature switch, normally closed, operably connected between the juncture of the first relay and the second switch and the juncture of the first switch and the hot gas valve solenoid; and means for detecting the temperature at the discharge end of the water freezing tube and opening the temperature switch for temperatures above a predetermined level.

3. An improved cycle control apparatus as recited in claim 2, wherein said means for detecting a low water level and for energizing the second relay comprises:

a first probe inserted in the water level control pan below the normal high water level of the pan;

a second probe inserted in the water level control pan below the normal high water level of the pan having electrical contact with said first probe only through the water in the water level control pan;

means for electrically grounding said first probe;

means for electrically connecting said second probe in series with the second relay; and means for electrically connecting said second relay to the power source so that said second relay is energized whenever water is above both probes in the water level control pan.

4. An improved cycle control apparatus as recited in claim 3, wherein said means for detecting the temperature at the discharge end of the water freezing tube and for opening the temperature switch for temperatures above a predetermined level, opens said temperature switch at an approximate temperature of 38° F.

5. An improved cycle control apparatus as recited in claim 4 wherein said first relay and said first switch and said second relay and said second switch are electromagnetic spring loaded relay switches.

* * * * *